US007271775B1

(12) United States Patent
Rossman et al.

(10) Patent No.: US 7,271,775 B1
(45) Date of Patent: Sep. 18, 2007

(54) DEPLOYABLE COMPACT MULTI MODE NOTCH/LOOP HYBRID ANTENNA

(75) Inventors: Court Rossman, Merrimack, NH (US); Katherine Zink, Litchfield, NH (US); Zane Lo, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 11/550,812

(22) Filed: Oct. 19, 2006

(51) Int. Cl.
*H01Q 21/00* (2006.01)
*H01Q 1/38* (2006.01)
*H01Q 9/28* (2006.01)

(52) U.S. Cl. ..... 343/728; 343/700 MS; 343/767; 343/795

(58) Field of Classification Search ..... 343/728, 343/795, 700 MS, 767
See application file for complete search history.

(56) References Cited

U.S. PATENT DOCUMENTS 4,358,773 A 11/1982 Staub, Jr. et al.
5,023,623 A 6/1991 Kreinheder et al.
5,654,724 A 8/1997 Chu
5,926,137 A 7/1999 Nealy
6,097,293 A * 8/2000 Galloway et al. ..... 340/572.8
6,452,549 B1 * 9/2002 Lo ..... 343/700 MS
6,480,158 B2 11/2002 Apostolos
6,950,066 B2 * 9/2005 Hendler et al. ..... 343/700 MS
2001/0020920 A1 9/2001 Shigihara
2001/0050640 A1 * 12/2001 Apostolos ..... 343/700 MS
2004/0090389 A1 * 5/2004 Jo et al. ..... 343/797
2005/0162332 A1 * 7/2005 Schantz ..... 343/795
2006/0055612 A1 3/2006 Kim et al.

FOREIGN PATENT DOCUMENTS

JP 3241901 10/1991
JP 5152827 6/1993
JP 9055609 2/1997
JP 2000278040 10/2000

* cited by examiner

*Primary Examiner*—Trinh Vo Dinh
(74) *Attorney, Agent, or Firm*—Maine & Asmus

(57) ABSTRACT

An antenna formed with a number of notch antennas forming an sectional inner ring and a sectional outer ring. Each of the notch antennas having a pair of leaves with a throat end proximate the inner ring and a leaf tip end proximate the outer ring, wherein the leaves are separated by a notch area. There is a lagoon interiorly disposed about the inner ring. At least one feed is coupled to at least one throat end. A lower horizontal loop couples each leaf tip and forms the outer ring. In addition, a plurality of slots separates each of the notch antennas.

11 Claims, 6 Drawing Sheets

DEPLOYABLE COMPACT MULTI MODE NOTCH/LOOP HYBRID ANTENNA

FIELD OF THE INVENTION

The invention relates to compact multi mode, broadband antennas, and more particularly, to a hybrid notch/loop array antenna.

BACKGROUND

Antenna configurations commonly fall into four basic types: 1) crossed dipoles, including resistive blades or bowties, 2) single loop antennas, 3) log periodic loops or dipoles, and 4) a ring array of notches.

Each of these has certain performance disadvantages as well as advantages. Resistively-loaded crossed dipoles typically have only a 4:1 pattern bandwidth, unless a severe resistive taper is used. However, this drives the efficiency below ten percent. Single loop antennas typically have only a 2:1 useful pattern bandwidth, limited by VSWR at the low frequency range and abnormal pattern behavior at the high end of the band when the diameter is one wavelength. Hemispherical log periodic loops or dipoles can not generate omni-directional patterns because directional beams from the antennas would be required to transmit through another antenna on the opposite side of the hemispherical structure, degrading the patterns. Ring arrays of notches can not achieve a low frequency band of radiation within a compact size. Large lagoons are typically used to achieve a low frequency match (essentially a large loop antenna at low frequencies where the notch mode does not radiate). If the physical structure is more than a wavelength defined at the low end of the band, then this pure ring array of notches, using the large lagoon, will work. However, the physical dimensions on compact structures (less than one wavelength at low end of band) are too small to support a large lagoon.

What is needed, therefore, is a broadband, horizontally-polarized, omni-directional antenna. Such an antenna should be conformal and able to be integrated onto a deployable structure, for communication and sensing applications.

SUMMARY OF THE INVENTION

One embodiment of the invention has an N-fold symmetry, and includes a plurality of N notch antennas having a sectional inner ring and a sectional outer ring. Each of the notch antennas having a pair of leaves with a throat end forming the inner ring and a leaf tip end proximate the outer ring, wherein the leaves are separated by a notch area. There is a lagoon interiorly disposed about the inner ring. At least one feed is coupled to at least one throat end. A lower horizontal loop couples each leaf tip and forms the outer ring. In addition, a plurality of slots separates each of the notch antennas. The antenna may be formed into a shape selected the group consisting of: hemispherical, conical, and elliptical. In one aspect, the antenna is made of a conductive fabric. The antenna may include a number of the notch antennas, such as two, three, four and six.

One embodiment includes a splitter proximate the lagoon and coupled to the feed line, wherein the splitter feeds all of notch antennas. In addition, the lagoon can include a metallic circular section.

The feed, according to one aspect is selected from at least one of the group consisting of twin line feed, flexible twin line feed, single conductive feed, flexible single conductive feed, and microstrip.

A further feature includes at least one reactive element proximate the leaf tip end. The reactive element can include capacitive loading and/or inductive loading. The reactive elements are proximate every other slot region.

An additional embodiment of the antenna includes wherein the outer ring radiates at a lower frequency than the inner ring.

In one embodiment, the antenna array structure, includes a plurality of spaced notch antennas, each notch antenna having a pair of elongated radiating elements separated by a notch area and having a first end and a second end, the radiating elements forming a side of the structure, wherein all of the notch antennas are arranged such that each first end forms a first ring and each second end forms a second ring. A lagoon is formed within the first ring. There is a plurality of slots defined between the spaced notch antennas. At least one feed is coupled to at least one first end, wherein the notches are fed at the first end by the feed, wherein the radiating elements are split to channel energy to the second end. The first ring radiates at a first frequency band and the second ring radiate at a second frequency band, wherein the first band is lower than the second frequency band.

The structure can further include a dipole antenna element coupled about the second end.

In addition, the structure can include a splitter located proximate the lagoon, wherein the feed is a single feed coupled to the splitter which then couples to each first end.

A further feature is that the structure can be stowed in a compact case until deployed.

In addition, the structure may also include different tapers on the leaves about the notch area for smoothing ripple at high frequencies in the first ring.

The antenna in one embodiment is a multi mode, hybrid notch/loop array. The notches form a ring toward the top of the hemispherical structure and may be directly fed at the throat using a flexible twin line transmission line. The leaves of the notches may be split, forming coplanar slot transmission lines, to channel energy down to a large horizontal loop antenna at the bottom of the hemisphere. There are two main radiation modes for this hybrid notch/loop antenna: the lower horizontal loop radiates at the lower frequencies, and the upper ring of notches radiate at the higher frequencies.

The two component array, in one embodiment, provides pattern and bandwidth features. Both the loop antenna mode and the notch array mode can have omni-directional patterns with horizontal polarization around the horizon. For perspective, a single-mode notch array by itself is very broadband. However, there is insufficient space within a compact hemispherical structure to create a notch array which will radiate efficiently at a sufficiently low frequency. A loop or dipole antenna mechanism added to the base of the hemispherical structure achieves radiation and low VSWR at lower frequencies.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

Note that the various features shown in the Figures are not drawn to any particular scale. Rather, the Figures are drawn to emphasize features and structure for purposes of explanation. The actual geometries and scale of the pertinent features and structure will be apparent in light of this disclosure.

DETAILED DESCRIPTION

Figure 1:
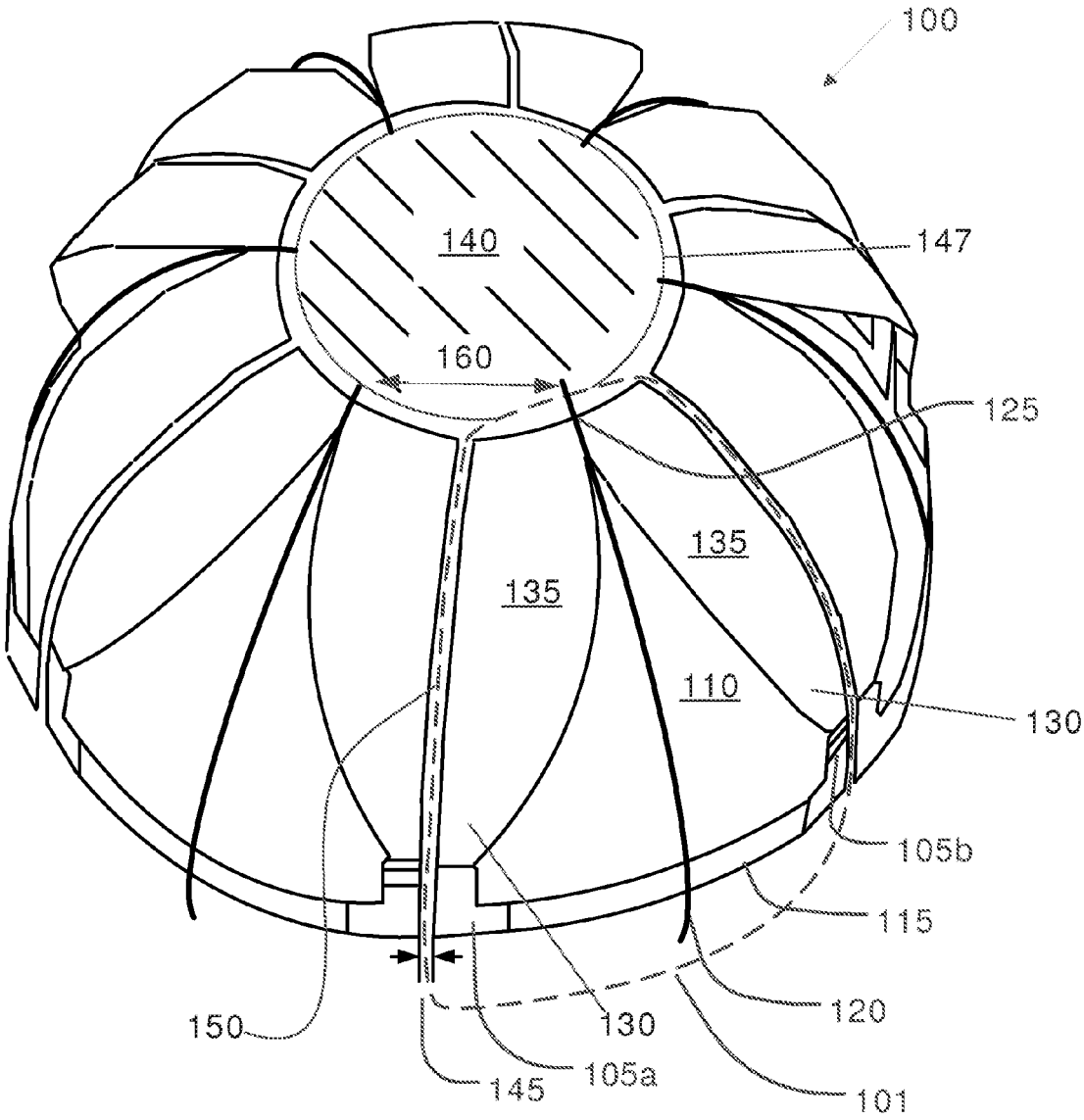
FIG. 1 depicts a compact multi mode, hybrid notch/loop antenna with reactive loading and six fold symmetry (6 notches and 6 feed points to lower horizontal loop) in accordance with one embodiment.

FIG. 1 is one embodiment of a multi mode, hybrid notch/loop antenna 100 with reactive loading at slot region 105*a* and having a six-fold symmetry. There are six notch antennas 101 formed by a six pairs of leaves 135, six notch areas 110, and with six feeds 120 having coplanar slots 150 separating each antenna 101 and providing coupling to the lower loop 115. Capacitive or inductive loading may be used at slot regions 105*a* and/or 105*b* to help improve the low frequency VSWR. This configuration retains the six-fold symmetry, and hence, any ripple in the omni-directional gain at high frequency has six-fold symmetry. The ripple at the higher frequency in the notch/upper ring mode can be smoothed using different tapers of the leaves 135 about the notch area 110; for example, stepped, linear or exponential flares away from the feed points.

The location of any reactive loading can be varied. For example, if capacitive loading is placed on every other slot region 105*a*/105*b*, this creates the possibility for three-fold symmetry: lower horizontal loop 115 now is partially broken up into three dipoles. Alternatively, no reactive loading needs to be used. The VSWR at low frequency is higher, but this geometry is mechanically more robust and may be easier to build.

Referring again to FIG. 1, a ring of notch antennas 101 form a hemispherical structure of the antenna 100, and is fed by feed lines 120 at a standard throat 125 of the notch area 110. There is a sectional inner ring formed by one end of the leaves 135 about the throat 125 and a sectional outer ring formed from the lower horizontal loop 115 and the leaf tips 130. The inner and outer rings are sectional as there are slots 150 separating each of the notch antennas 101. A large effective loop is formed at leaf tips 130 of notches 110. All leaves 135 in this embodiment are split to form coplanar waveguides 150 to feed the lower horizontal loop 115. Reactive elements can be placed at the slot regions base of the vertical loops to improve the low frequency match.

The radiating element or leaves 135 are termed as such because in this embodiment a pair of adjacent leaves resemble a leaf. While the shape of the leaves 135 can vary significantly depending upon the design criteria, the term leaf and leaves will be used herein for convenience but shall not be deemed as limiting the shape of the radiating element.

There are two main radiation mechanisms for the notch/loop hybrid antenna 100: lower horizontal loop 115 at lower frequency, and the notch/upper ring mode at higher frequencies. In the ideal case, lower horizontal loop 115 will radiate for frequencies below a one wavelength diameter of the loop (as in the single loop antenna, a null occurs when the loop is a one wavelength diameter), and the traveling wave mode of notch 110 will radiate at higher frequencies. Pattern distortion will occur at the transition frequency between the two modes, similar to any multi-mode antenna. The pattern stability through the transition between the two modes is aided by the curvature of the notches down to the lower horizontal loop 115: the radiation fields from notch 110 are offset and directed above lower horizontal loop 115, and this spatial offset may reduce high frequency scattering off the lower horizontal loop 115 and reduce lobing in the elevation pattern at the transition frequency between the two modes.

Notch separation 160 is defined as the distance between feed points of adjacent notches, wherein such spacing should be about one-quarter wavelength at the upper frequency, to reduce ripple in the pattern around the horizon.

The lagoon 140 is the center portion of the inner ring formed by the notch antennas 101. The diameter of lagoon 140 should be less than one wavelength at the upper frequency, to preserve gain along the horizon at the upper frequency. If the diameter of lagoon 140 is larger, a metal disk 147 can be placed in the lagoon to act as a marginal ground plane. The lagoon 140 diameter, assuming reasonable diameters such as less than one wavelength diameter at the high band wavelength, has little impact on the VSWR at low frequency because at low frequencies the lower horizontal loop 115 is causing the radiation and not the upper ring formed by notch antennas 101. At low frequency, this upper ring acts simply as a transmission line to get energy to the lower loop.

It should be noted that each notch element 101 has a large backlobe. For standard, planar, two dimensional flat notch arrays with a large ground plane behind the notch, the backlobe would be very small or non-existent for very large ground planes. However, for this ring of notches 101, there is no large ground plane redirecting all the energy down the notch. The notch 110 will radiate in both directions, and the backlobes will interfere with the front lobes of the notch on the opposite side of the lagoon. This is why, for in phase uniform excitation of the notches, the diameter of the lagoon 140 should be smaller than one wavelength, to avoid destructive interference along the horizon.

Slot width 145 and impedance of the coplanar waveguide slot 150 affect the coupling of energy to this coplanar waveguide slot 150 and consequently coupling of energy down to lower horizontal loop 115. Wider gaps 145 at the coplanar waveguide slot 150 cause more coupling to lower horizontal loop 115, and improves the low frequency VSWR. Narrower gaps 145 decrease the excitation of lower horizontal loop 115 and decrease low frequency gain.

Experimentally, it was found that the low frequency VSWR cutoff is determined by the perimeter length of the local vertical loop formed around notch antenna 101. Surprisingly, this low frequency VSWR cutoff is not determined by the diameter of the entire loop, but by the individual vertical loops. Hence sixfold symmetry has a higher cutoff frequency, compared to 4-fold or less symmetry. This low-frequency cutoff distinction is detailed herein.

The frequency of the lower resonance of the vertical loops can be reduced using reactive loading. The loading should typically be near the lower horizontal loop 115 for two reasons: one, lower horizontal loop 115 is causing the radiation and should be the geometry that is manipulated, and, two, reactive loading near the notch throat 125 would affect the high frequency notch mode.

On a theoretical note, when all notch antennas 101 are fed equally and in phase, some unique and constrained E fields exist in various vertical planes cutting through the center of the antenna. The E fields are transverse (azimuthal) to the plane cutting through the slots, and the E fields are also transverse (azimuthal) to the plane cutting through the center of the notches. These vertical symmetry planes exists both through slots 150 between the leaves 135 and also through the feed lines 120 of notch antennas 101 at the throat of the notches 125. These vertical planes are proximate to and may pass through the center of the antenna 100. In one embodiment, metal sheets could be placed along these symmetry planes with little impact. To illustrate the point, any metal placed in the plane along these symmetry planes will not impact the antenna, and no current will be excited on these metal pieces.

On the practical note, these two sets of vertical symmetry planes, for in phase, uniform excitation, have two consequences. First, the symmetry planes create the equivalent of an inductive loop through the center of the lagoon 140. If this loop is too small, then the feed has a shunt series LC network which impacts the match. Second, the symmetry plane through the notch feed point allows a twin line feed to be run up the middle of each notch (as displayed as 120 in FIG. 1), or run up the air gap 150 between notch leaves 135, without exciting unbalanced common currents flowing back down the feed line 120. The feed configuration can also use a twin feed line.

The twin lines are naturally balanced feeds and common current will be suppressed. They are also flexible, which can be a mechanical concern for a deployable application. Also, due to the simplicity, there are few impedance transitions to cause mismatch issues. According to one embodiment, there is an N-way 0 degree splitter (not shown) where all the twin lines converge together. Notch antennas 101 could be fed in many other ways. For example, a single feed line, not multiple lines, can run up one of the leaves 135 to a splitter placed inside the lagoon 140, which in turn feeds all the notches in phase. Alternately, a twin line can run from the payload to the base of deployed antenna 100. At the interface, the twin line can either be run over a metal fabric of a notch leaf 135, or the twin line can be converted to a stripline.

The feed locations should be at the high frequency radiation locations, similar to log-periodic antennas. In one example, that high frequency location is the feed point for the notch 125. If the feed location were at the low frequency loop, then at high frequency the radiation would occur from a traveling wave mechanism on the loop and multi-lobe patterns would emerge. By feeding at the high frequency notch location, the high frequency radiation is in the notch as a traveling wave. It is the intent, at high frequency, that very little energy gets to the low frequency loop before radiating.

The antenna design can be implemented for both omni and diversity applications. The availability of multiple feed points can lend itself to separate directional patterns. For example, the in-phase omni-directional pattern can be used when the receive or transmit direction is unknown. A directive pattern can be sent back to re-transmit once the direction is known. This example is similar to "smart" antennas in cell phone towers.

According to one embodiment, the antenna 100 is formed as a hemispherical structure with the lagoon 140 representing one end and the lower horizontal loop 115 representing the other end.

The following embodiments depict various symmetries for the antenna, such as 3 and 4 fold symmetry. The lower frequency element, fed by the coplanar slots between the notches, can also be a dipole element. Other order symmetries are possible, and these examples of embodiments are not meant to be exhaustive.

Figure 2:
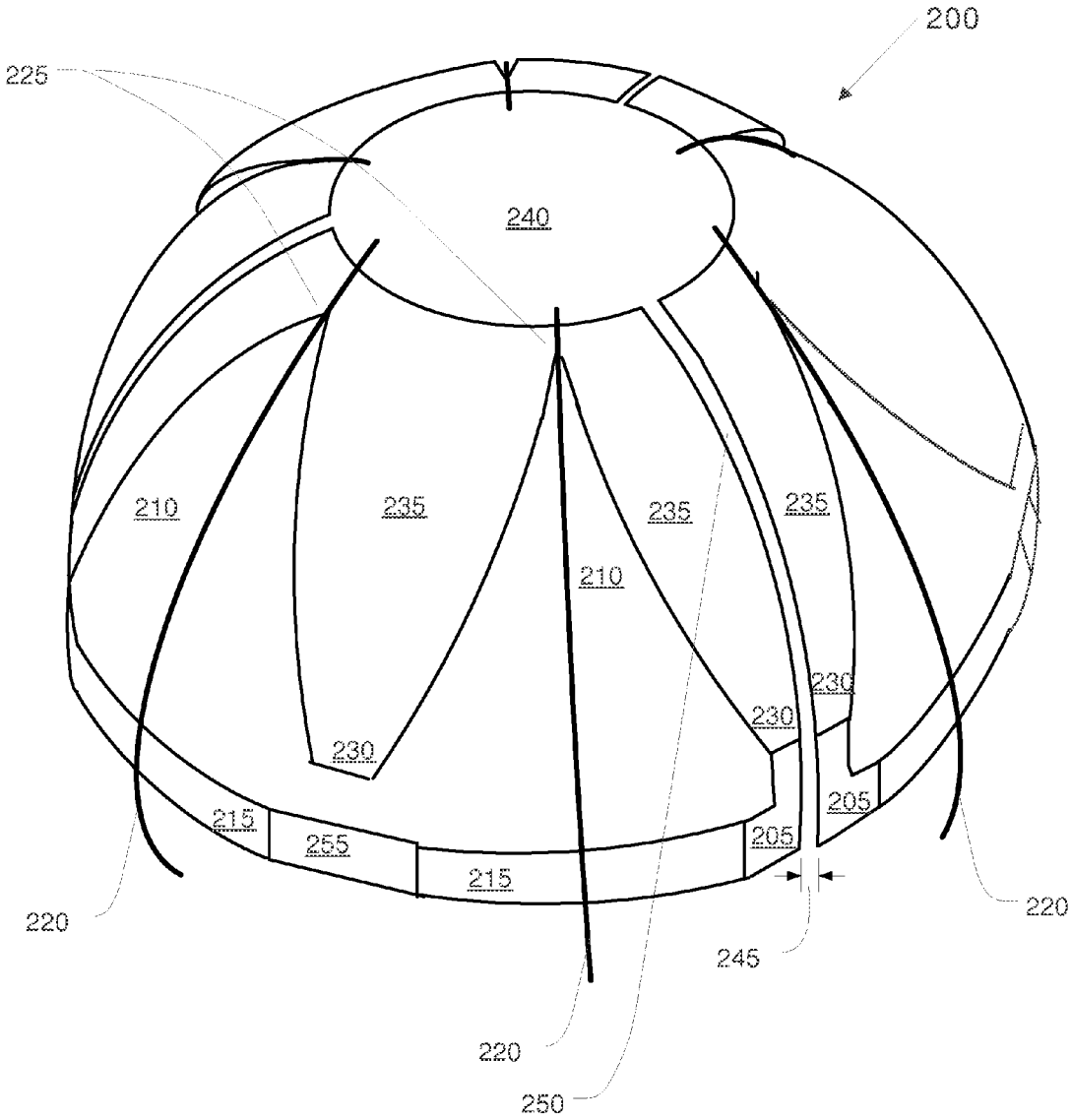
FIG. 2 depicts a multi mode, hybrid notch/loop antenna with six notches and three feed points to the lower horizontal loop in accordance with one embodiment.

FIG. 2 depicts a multi mode, hybrid notch/loop antenna 200 having six feed lines 220 with six notches 210 having three local vertical loops and three coplanar slot feed points 250 to lower horizontal loop 215. This configuration has a lower resonant frequency due to the large vertical loops, which control the low frequency VSWR cutoff. Ripple may occur around the horizon in mid band due to the three-fold symmetry.

While the embodiment of FIG. 1 has slots 150 for each leaf 135, the embodiment depicted in FIG. 2 has waveguide slots 250 in alternate leaves 235 with corresponding slot regions 205. Similar to other embodiments, this embodiment has a lagoon 240, gap width 245, and leaf tips 230. Distinctively, leaf tips 230 are alternately opposite lower horizontal loop regions 255 and slot regions 205. The lower cutoff frequency due to VSWR will be lower for this antenna, with three large vertical loops, compared to a higher symmetry antenna with four or more vertical loops. However, the ripple in the omni-directional azimuthal gain will appear at lower frequencies, compared to the higher symmetry case.

Figure 3:
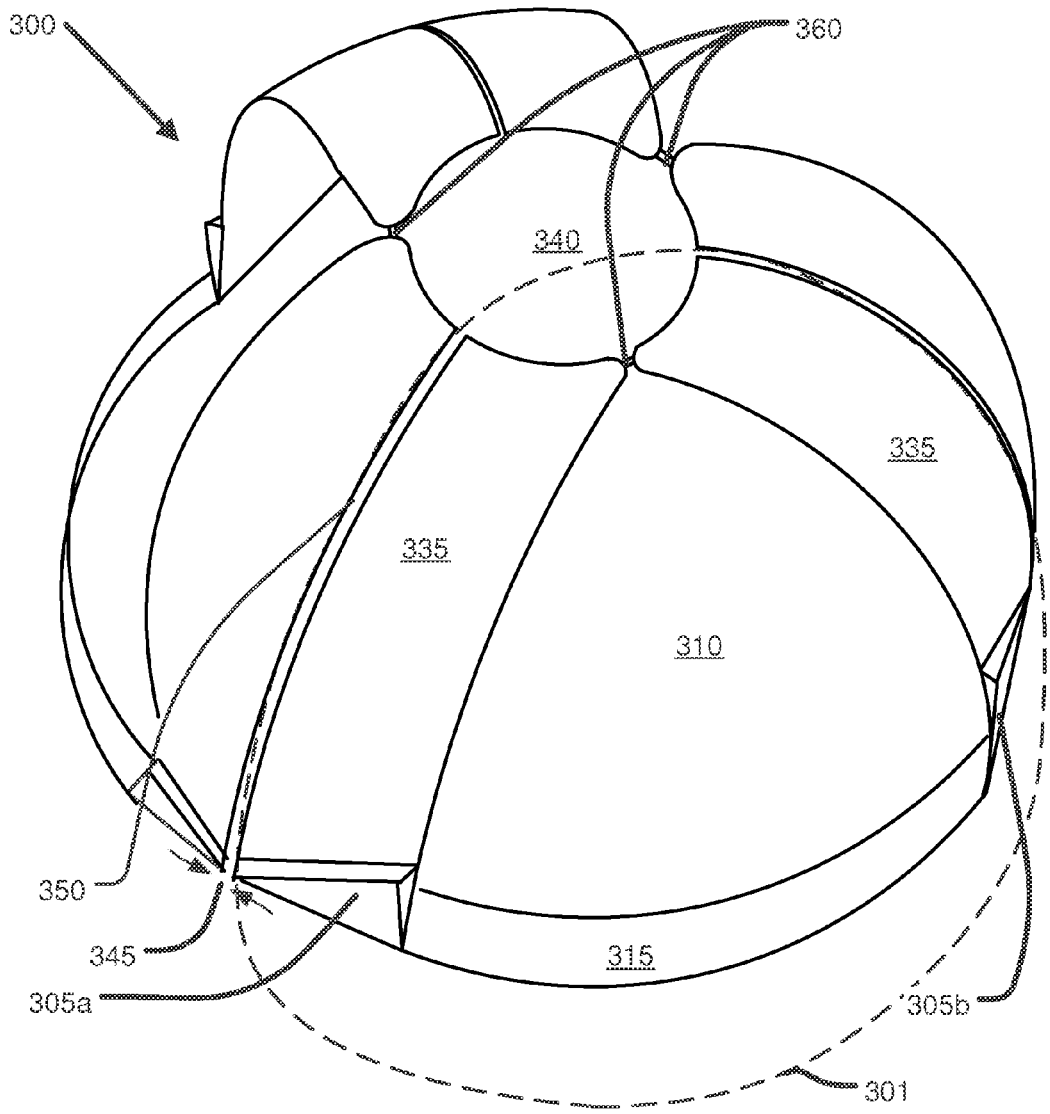
FIG. 3 depicts a three fold symmetry version of a hybrid antenna embodiment in accordance with one embodiment.

FIG. 3 depicts a version of a hybrid antenna 300 with three-fold symmetry; three notch antennas 301, formed by three notch areas 310. Depending upon design criteria, this version typically has more ripple compared to the six-fold version, due to the lower symmetry.

As with the embodiment of FIG. 1, this embodiment has slots 350 in each leaf 335. Again, similar to other embodiments, this embodiment has a lagoon 340, gap width 345, and leaf tips 330 opposite slot regions 305 in lower horizontal loop 315. Distinct from previous embodiments, the embodiment of FIG. 3 includes twin line feeds 360. The twin feed lines 360 couple the leaf sections 335 of the notch antennas 301. According to one embodiment, the slot region 305*a* is formed into a triangular shape, one version of a tapered notch antenna, with one point opposing a point from the other slot region 305*b*.

Figure 4:
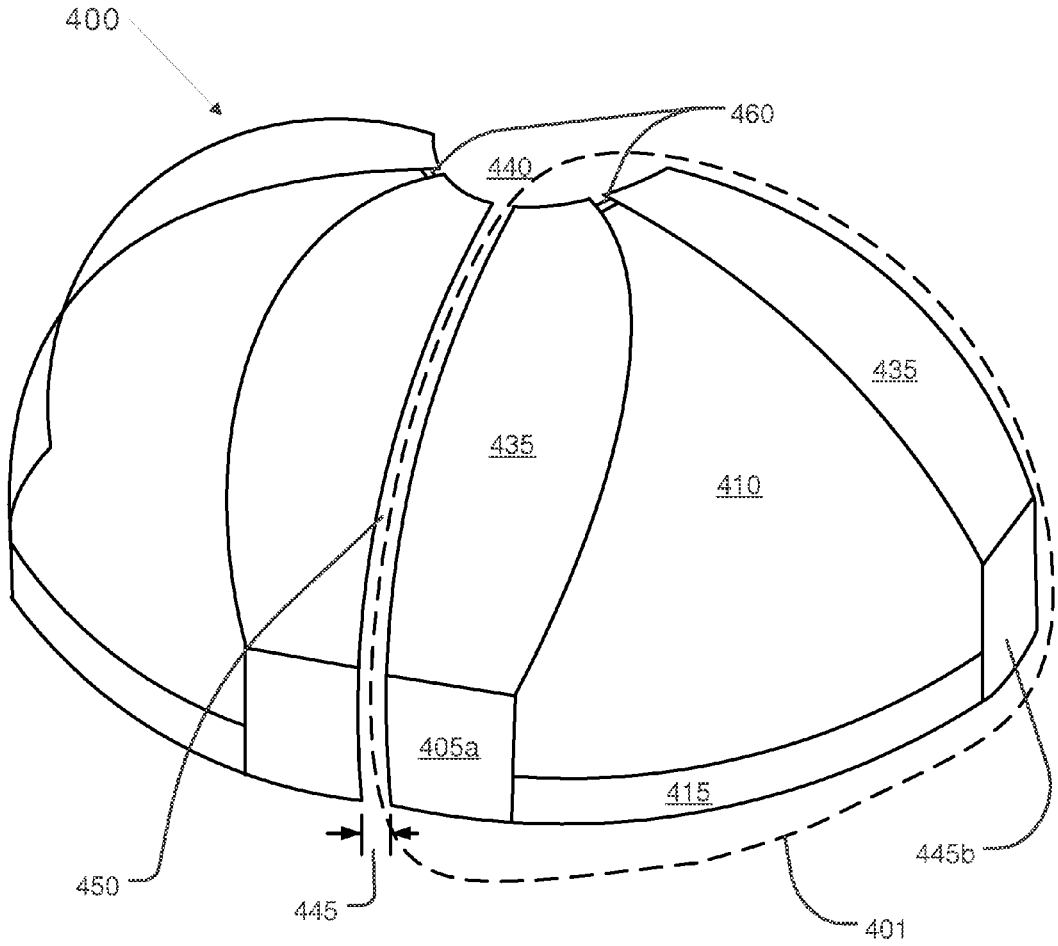
FIG. 4 depicts a four fold symmetry (half symmetry) version of a hybrid antenna embodiment in accordance with one embodiment.

FIG. 4 depicts a four-fold symmetry (half symmetry) antenna 400 having four notch antennas 401 formed by four notch areas 410. Only half of the antenna is illustrated for convenience. Once again, design criteria, this version may have more ripple, compared to the six-fold version, due to the lower symmetry.

Similar to the embodiment of FIG. 3, the embodiment of FIG. 4 has slots 450 of gap width 445 in each leaf 435, a lagoon 440, and twin line feed 460. This embodiment also has slot regions 405 at the intersection of leaves 435 and lower horizontal loop 415. In contrast to the embodiment of FIG. 3, this embodiment has four notch antennas 401 versus the three notch antennas of FIG. 3.

Figure 5:
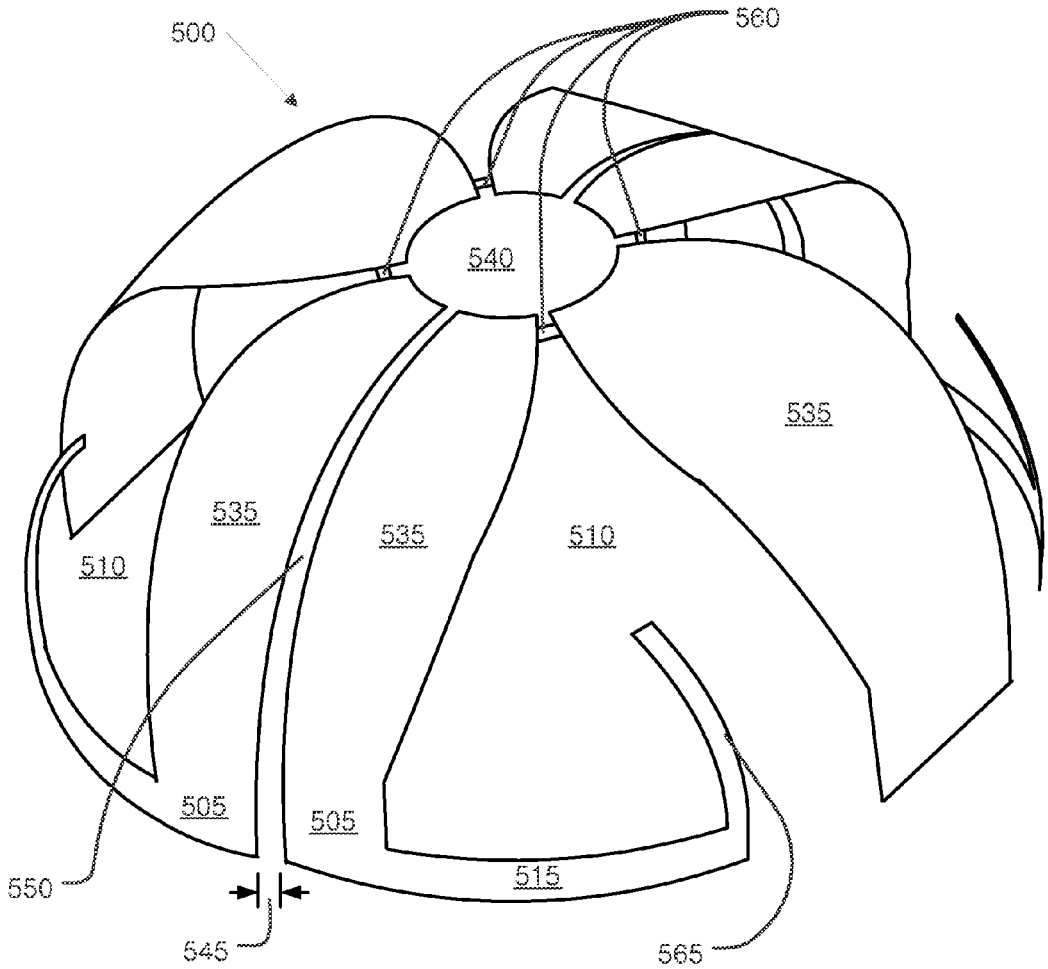
FIG. 5 depicts a two fold symmetry version using four notches and dipole low frequency elements instead of loop elements in accordance with one embodiment.

FIG. 5 depicts an antenna 500 having two-fold symmetry, using four notches 510 and dipole 515 low frequency elements instead of loop elements. The coplanar slots 550 are now feeding a dipole instead of a large loop. This embodiment will have a lower cutoff frequency compared to a three-fold or higher symmetry antenna. The dipole resonance frequency determines the lower cutoff frequency.

Similar to the embodiment of FIG. 4, this embodiment has a lagoon 540, and twin line feeds 560. Distinct from the embodiment of FIG. 4, slots 550 of gap width 545, are in alternate leaves 535. This embodiment also has orthogonal dipole ends 565 opposite slot regions 505. The dipoles allow low frequency tuning. They may also interact less than the loops with the high frequency radiation coming from the notch mode at higher frequencies. Two large dipoles around the lower perimeter of the antenna also allow the possibility of slightly directional patterns at the low frequencies, if this is desired.

Figure 6:
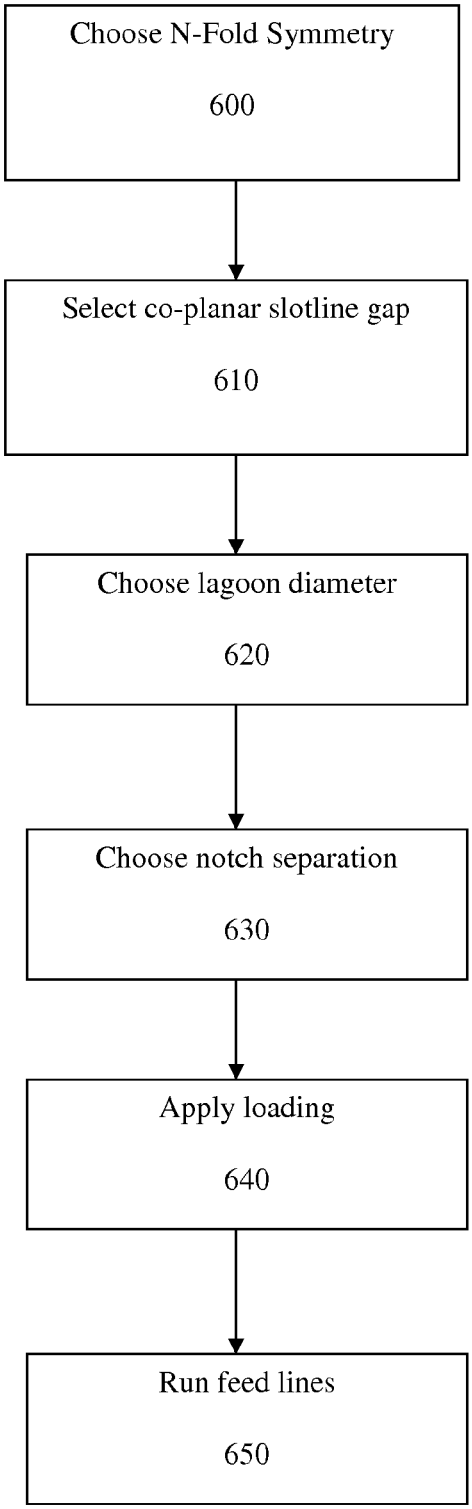
FIG. 6 shows a method for designing the hybrid loop/notch antenna in accordance with one embodiment.

There are various manners in which the antenna of the present invention can be constructed or manufactured. Referring to FIG. 6, various design rules for the hybrid loop/notch antenna are depicted according to one embodiment.

The first step is to choose the N-fold symmetry 600. The number of folds is based on a trade-off between pattern ripple at the high end of the band versus low frequency VSWR. More N-fold symmetry reduces ripple, but reduces bandwidth by increasing the low frequency cutoff. As shown herein, 2, 3, 4, and 6 fold symmetry designs were depicted. The design criteria in terms of bandwidth and acceptable ripple will aid in establishing the N-fold requirements.

The next step is to choose the coplanar slotline gap 610. The gap is typically based on the requirements related to the high frequency pattern ripple versus low frequency VSWR. Larger gaps improve the low frequency VSWR, but increase ripple at high frequency. Larger width gaps are known to radiate more, and hence offer a generally undesirable radiation mode for the antenna. The gap radiation will constructively and destructively interfere with the loop and notch mode radiation. Thus the design parameters generally dictate the allowable VSWR versus ripple requirements and thereby establish the gap.

The processing continues with selecting the lagoon diameter 620. According to one embodiment, the lagoon diameter is established as being slightly less than one wavelength diameter (for example, 2 feet diameter at 500 MHz) at the upper end of the band, to avoid radiation cancellation between open-notches on opposite sides of the lagoon when fed in phase. Thus by having the bandwidth requirements and knowing the upper end of the band, the diameter of the lagoon can be established.

Picking the notch separation is the next step 630. In one embodiment, the notch separation is about a quarter wavelength, or less with respect to the upper end of band in order to avoid pattern ripple. More notches and less notch separation will require smaller radiation loops, and hence degrade the lower frequency match, but the ripple will be less at higher frequencies.

An optional step is to apply loading 640 to the vertical loops to improve low frequency match, and reduce the resonance frequency of the vertical individual loops. As detailed herein, capacitive or inductive loading may be used at the slot regions to help improve the low frequency VSWR. For example, if the loops are behaving as a typical loop, then a series capacitance will bring the resonance frequency down.

Finally, the feed lines are run to couple the antenna elements 650. In one embodiment, there is one feed line with a splitter in the lagoon. In another embodiment, multiple feed lines can further include a splitter beneath the antenna. The feed line can run along an E-perpendicular symmetry plane to avoid exciting commons mode current along the wires and generating cross polarization or pattern ripple. Twin lines may also be used as they are advantageous due to low loss, physical flexibility, and balanced currents.

One embodiment of the present invention achieves efficient, omni-directional horizontal-polarization radiation over a broad 10:1 frequency bandwidth and may be deployed from a very small package. It may be integrated onto a deployable structure for applications such as communications and sensing. For example, the antenna may be integrated onto and conformal to a hot-air balloon, a gliding device, a floating device, a blimp, or other similar structures. Its 10:1 bandwidth covers VHF and UHF frequencies, with an average gain of greater than −5 dBi along the horizon. The footprint of the antenna can vary in size, but in one embodiment covers approximately a forty-two inch diameter hemisphere. An embodiment may be folded into a compressed payload and survive for many years in storage.

In a particular embodiment, the pattern is omni-directional around the horizon, achieving a full 360 degree field of view. The elevation window is approximately fifteen degrees above and fifteen degrees below. The antenna can be positioned in the horizontal plane, or a folded variant, such as the top of a spherical surface. In one embodiment, the antenna can be integrated onto deployable air structures. The antenna may be made of conductive fabric such as Electromagnetic Interference (EMI) shielding material, and fed using flexible twin line transmission lines. Possible technologies for the conductive fabric are vapor deposition or an approach similar to a stencil to spray on a conductive coating (e.g., silver paint). The diameter of a hemispherical structure would accommodate a low band loop antenna, and a ring of notches would be included for higher frequencies. Included in the design is a technique to transition between the two radiation modes using one feed point. Such a flexible framework for the antenna allows the antenna to be stored in a small form factor and expands into the full antenna when deployed.

As an example, one application is for a broadband, horizontally-polarized, omni-directional antenna, conformal and integrated onto a deployed structure, for communication and sensing applications. The features and goals for the antenna can include a broad pattern coverage. For example, an omni-directional pattern around the horizon is required to achieve a full 360 degree field of view. The elevation window can be about +/−15 degrees above and below the horizon to facilitate robust line of sight communication, over a broad range of distances. The present invention provides an omni-directional horizontal polarization, which is more difficult to achieve than the omni-directional vertical polarization, which just requires a single dipole. Standard omni-directional antennas are circularly polarized (CP) crossed dipoles and loops, but these do not have large enough bandwidth. While a circular array of standard notches does have bandwidth, it will not fit onto a $\frac{1}{3}^{rd}$ wavelength structure as with the present invention. In addition, the present invention gives a large 10:1 pattern bandwidth which is needed to provide the capability to receive and transmit over many frequencies. The standard CP crossed dipoles, or loops, do not have a 10:1 pattern bandwidth.

As noted, a feature of the present invention is that it can be an integrated antenna and integral onto deployable structures. The antenna can be made of conductive fabric and use flexible feed cables so that it can be folded into a compressed small carrier before deployment. According to one embodiment, the antenna could be integrated onto and conformal to a hot-air balloon, gliding device, floating device, blimp, or other similar structures. The antenna would operate over a 10:1 bandwidth, with an average gain of greater than −5 dBi along the horizon. The footprint of the antenna covers a $1/3^{rd}$ of a wavelength diameter hemisphere at low end of band.

One of the embodiments includes having a diameter of hemispherical structure for a low band loop antenna and a ring of notches at the higher frequencies. One of the design issues was designing a technique to transition between the two radiation modes using one feed point.

The antenna in one embodiment is comprised of a dual mode, hybrid notch/loop array antenna. The notches form a ring toward the top of the hemispherical or curved structure and the notches are directly fed at the throat using a flexible twin line transmission line. The leaves of the notches are split to channel energy to a large horizontal loop antenna at the tips of the notch leaves. There are two main radiation modes for this hybrid notch/loop antenna, namely the lower horizontal loop that radiates at the lowest frequencies, and the upper ring of notches that radiate at the highest frequencies.

Certain features include an omni-directional pattern wherein both the loop antenna mode and the notch array mode have omni-directional patterns. Both the loop antenna mode and the notch array mode have horizontal polarization around the horizon. A notch array by itself is a very broadband antenna, but only if the antenna size is electrically large. However, to fit into the spatial requirements of an electrically small hemispherical structure, there is typically not enough space to create a notch array which will radiate efficiently at a low enough frequency. A loop antenna mechanism is added to the base of the hemispherical structure to achieve radiation and excellent impedance matching at the low frequencies.

A further feature of the present invention includes integrating the antenna onto a deployable structure, as the antenna is made of conductive fabric and fed using flexible twin line transmission lines. Possible technologies for the conductive fabric are vapor deposition, which has a long lifetime without cracking, and using a similar concept to a stencil to spray on a conductive coating for shorter lifetimes. This invention can be applied to almost any kind of shape, such as an ellipse, cone, etc., and these shapes can be flexible or non-flexible. In one embodiment, the deployable structure is compressed into a smaller carrier that can be expanded when deployed.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. An antenna having an N-fold symmetry, comprising:

a plurality of N notch antennas having a sectional inner ring and a sectional outer ring, each of said notch antennas having a pair of leaves with a throat end proximate said inner ring and a leaf tip end proximate said outer ring, wherein said leaves are separated by a notch area;

a lagoon interiorly disposed about said inner ring;

at least one feed coupled to at least one said throat end;

a lower horizontal loop coupling each said leaf tip and forming said outer ring; and a plurality of slots, said slots separating each of said notch antennas.

2. The antenna according to claim 1, further comprising a splitter proximate said lagoon and coupled to said feed line, wherein said splitter feeds all of said notch antennas.

3. The antenna according to claim 1, wherein said feed is selected from at least one of the group consisting of twin line feed, flexible twin line feed, single conductive feed, flexible single conductive feed, and microstrip.

4. The antenna according to claim 1, wherein said lagoon further includes a metallic circular section.

5. The antenna according to claim 1, wherein said antenna is formed into a shape selected the group consisting of: hemispherical, conical, and elliptical.

6. The antenna according to claim 1, wherein at least one reactive element is proximate said leaf tip end.

7. The antenna according to claim 6, wherein said reactive element include at least one of capacitive loading and inductive loading.

8. The antenna according to claim 6, wherein said reactive elements are proximate every other slot region.

9. The antenna according to claim 1, wherein said antenna is made of a conductive fabric.

10. The antenna according to claim 1, wherein a number of said notch antennas is selected from the group consisting of: two, three, four and six.

11. The antenna according to claim 1, wherein said outer ring radiates at a lower frequency than said inner ring.

* * * * *